US011281138B2

(12) United States Patent
Kikuchi

(10) Patent No.: US 11,281,138 B2
(45) Date of Patent: Mar. 22, 2022

(54) HEATING APPARATUS HAVING A CYLINDRICAL FILM AND A PRESSING ELEMENT TO FORM NIP

(71) Applicant: TOSHIBA TEC KABUSHIKI KAISHA, Tokyo (JP)

(72) Inventor: Kazuhiko Kikuchi, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/100,303

(22) Filed: Nov. 20, 2020

(65) Prior Publication Data

US 2021/0072685 A1 Mar. 11, 2021

Related U.S. Application Data

(63) Continuation of application No. 16/728,970, filed on Dec. 27, 2019, now Pat. No. 10,877,410.

(30) Foreign Application Priority Data

Feb. 8, 2019 (JP) ..... JP2019-021853

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2017; G03G 15/2028; G03G 15/2053; G03G 2215/2035
USPC ..... 399/329; 219/216
See application file for complete search history.

(56) References Cited

U.S. PATENT DOCUMENTS

| | | | | |
|---|---|---|---|---|
| 9,766,579 | B2 * | 9/2017 | Ikegami | G03G 15/2053 |
| 9,851,669 | B2 * | 12/2017 | Moriya | G03G 15/206 |
| 10,578,998 | B1 | 3/2020 | Koyanagi et al. | |
| 2003/0077092 | A1 | 4/2003 | Ogawa et al. | |
| 2012/0121284 | A1 | 5/2012 | Iwasaki | |
| 2015/0037052 | A1 | 2/2015 | Muramatsu et al. | |

(Continued)

FOREIGN PATENT DOCUMENTS

| | | | |
|---|---|---|---|
| JP | 2001-194936 | A | 7/2001 |
| JP | 2003-186321 | A | 7/2003 |

(Continued)

OTHER PUBLICATIONS

Extended European Search Report dated Jul. 10, 2020 in corresponding European Patent Application No. 20156022.4, 8 pages.

*Primary Examiner* — Robert B Beatty
(74) *Attorney, Agent, or Firm* — Kim & Stewart LLP

(57) ABSTRACT

A heating apparatus includes a cylindrical film and a pressing element that rotates with the cylindrical film and forms a nip with the cylindrical film. A medium is conveyed through the nip from an upstream side to a downstream side. The heating apparatus further includes a guide member arranged inside the cylindrical film and including a first end portion that contacts the cylindrical film at a location that is downstream of an upstream end of the nip, and a substrate arranged inside the cylindrical film and on which a heating element is disposed. An upstream end of the substrate is located downstream of the first end portion of the guide member.

18 Claims, 6 Drawing Sheets

(56) References Cited

U.S. PATENT DOCUMENTS

| | | | |
|---|---|---|---|
| 2016/0026131 | A1 | 1/2016 | Sato et al. |
| 2016/0062281 | A1 | 3/2016 | Minamishima et al. |
| 2017/0364001 | A1 | 12/2017 | Takagi et al. |
| 2017/0364005 | A1 | 12/2017 | Kikuchi et al. |
| 2017/0367152 | A1 | 12/2017 | Takagi et al. |

FOREIGN PATENT DOCUMENTS

| | | | |
|---|---|---|---|
| JP | 2004-191797 | A | 7/2004 |
| JP | 2007-328158 | A | 12/2007 |
| JP | 2015-114592 | A | 6/2015 |
| JP | 2016-136236 | A | 7/2016 |

* cited by examiner

HEATING APPARATUS HAVING A CYLINDRICAL FILM AND A PRESSING ELEMENT TO FORM NIP

CROSS-REFERENCE TO RELATED APPLICATIONS

This application is a continuation of U.S. patent application Ser. No. 16/728,970, filed Dec. 27, 2019, which is based upon and claims the benefit of priority from Japanese Patent Application No. 2019-021853, filed on Feb. 8, 2019, the entire contents of which are incorporated herein by reference.

FIELD

An embodiment of the present invention relates to a heating apparatus and an image processing apparatus.

BACKGROUND

An image forming apparatus for forming an image on a sheet includes a heating apparatus for fixing a toner (i.e., recording agent) to the sheet. There is a need for improving durability of such a heating apparatus.

DETAILED DESCRIPTION

The heating device according to the embodiment includes a cylindrical film and a pressing element that rotates with the cylindrical film and forms a nip with the cylindrical film. A medium is conveyed through the nip from an upstream side to a downstream side. The heating apparatus further includes a guide member arranged inside the cylindrical film and including a first end portion that contacts the cylindrical film at a location that is downstream of an upstream end of the nip, and a substrate arranged inside the cylindrical film and on which a heating element is disposed. An upstream end of the substrate is located downstream of the first end portion of the guide member.

Figure 1:
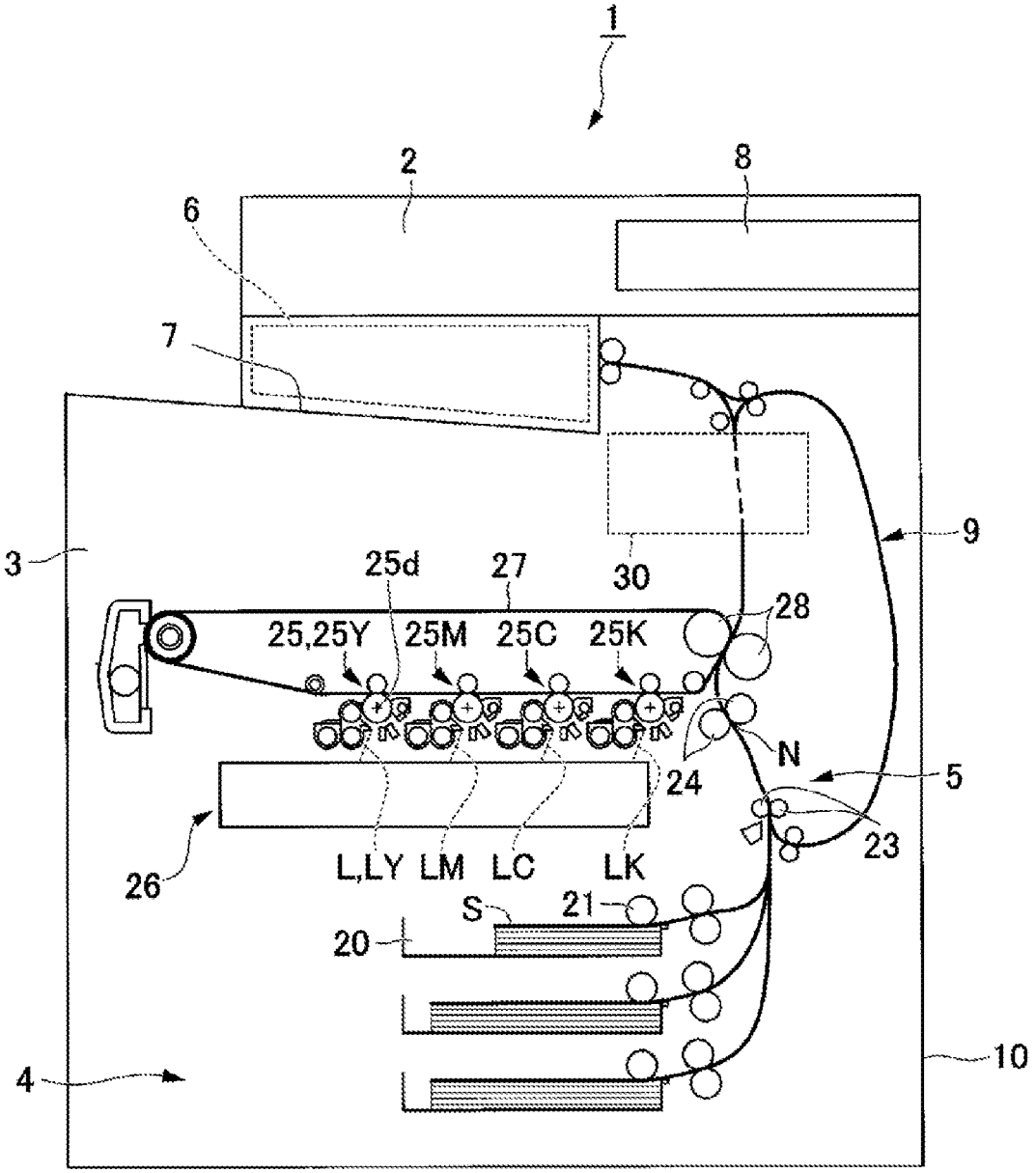
FIG. 1 is a schematic configuration diagram of an image forming apparatus according to one embodiment.

Hereinafter, as an example of an image processing apparatus and a heating apparatus, an image forming apparatus and a fixing unit will now be described with reference to the accompanying drawings. FIG. 1 is a schematic configuration diagram of an image forming apparatus according to one embodiment of the present invention. The image forming apparatus 1 performs a processing of forming an image on a sheet of paper S. The image forming apparatus 1 includes a housing 10, a scanner unit 2, an image forming unit 3, a sheet supply unit 4, a conveying unit 5, a sheet discharge tray 7, a reversing unit 9, a control panel 8, and a controller 6.

The housing 10 forms an outer shape of the image forming apparatus 1. The scanner unit 2 reads image information of an object to be copied to obtain reflected light with various light intensity and generates an image data. The scanner unit 2 outputs the generated image data to the image forming unit 3. The image forming unit 3 forms an output image (hereinafter referred to as a toner image) by a recording agent such as toner on the basis of the image data received from the scanner unit 2 or an image data received from an external device. The image forming unit 3 transfers the toner image onto the surface of the sheet S. The image forming unit 3 heats and pressurizes the toner image on the surface of the sheet S to fix the toner image on the sheet S. The details of the image forming unit 3 will be described later.

The sheet supply unit 4 supplies the sheet S to the conveyance unit 5 in accordance with the timing at which the image forming unit 3 forms a toner image on the sheet S. The sheet supply unit 4 includes a sheet storage unit 20 and a pickup roller 21. The sheet storage unit 20 accommodates the sheet S of a predetermined size and type. The pickup roller 21 takes out the sheets S one by one from the sheet storage unit 20. The pickup roller 21 supplies the taken-out sheet S to the conveyance unit 5.

The conveyance unit 5 conveys the sheet S supplied from the sheet supply unit 4 to the image forming unit 3. The conveyance unit 5 includes a conveying roller 23 and a registration roller 24. The conveying roller 23 conveys the sheet S supplied from the pickup roller 21 to the registration roller 24. The conveying roller 23 presses the leading end of the sheet S in the conveying direction against the nip N of the registration roller 24. The registration roller 24 bends the sheet S in the nip N to thereby adjust the position of the leading edge of the sheet S in the conveying direction. The registration roller 24 conveys the sheet S synchronizing with the timing at which the image forming unit 3 transfers the toner image to the sheet S.

The image forming unit 3 will now be described. The image forming unit 3 includes a plurality of image forming units 25 (25Y, 25M, 25C, and 25K), a laser scanning unit 26, an intermediate transfer belt 27, a transfer unit 28, and a fixing unit 30. Each of the image forming units 25 includes a photosensitive drum 25*d*. Each of the image forming units 25 forms a toner image on the photosensitive drum 25*d* in accordance with the image data from the scanner unit 2 or an external device. The plurality of image forming units 25Y, 25M, 25C and 25K form toner images of yellow, magenta, cyan and black toners, respectively.

A charger, a developing device, and the like are disposed around the photosensitive drum 25*d* of each of the image forming units 25Y, 25M, 25C, and 25K. The charging device charges the surface of the photosensitive drum 25*d*. The developing device of each of the image forming units 25Y, 25M, 25C, and 25K contains developer containing one of yellow, magenta, cyan and black toners. The developing device develops the electrostatic latent image on the photosensitive drum 25*d*. As a result, a toner image is formed by the toner of each color on the corresponding photosensitive drum 25*d*.

The laser scanning unit 26 scans the charged photosensitive drum 25*d* with the laser beam L to expose the photosensitive drum 25*d*. The laser scanning unit 26 exposes the photosensitive drums 25*d* of the image forming units 25Y, 25M, 25C and 25K of the respective colors with the respective laser beams LY, LM, LC and LK. In this manner, the laser scanning unit 26 forms an electrostatic latent image on the photosensitive drum 25*d*.

The toner image on the surface of the photosensitive drum 25*d* is primarily transferred onto the intermediate transfer belt 27. The transfer unit 28 transfers the toner image primarily transferred onto the intermediate transfer belt 27 onto the surface of the sheet S at the secondary transfer position. The fixing device 30 heats and pressurizes the toner image transferred to the sheet S to fix the toner image on the sheet S. The details of the fixing device 30 will be described later.

The reversing unit 9 inverts the sheet S to form an image on a back surface of the sheet S. The reversing unit 9 reverses the sheet S discharged from the fixing device 30 by switch-back. The reversing unit 9 conveys the reversed sheet S toward the registration roller 24. The sheet discharge tray 7 holds the sheet S that has been ejected with an image formed thereon. The control panel 8 is a part of an input unit for inputting information for an operator to operate the image forming apparatus 1. The control panel 8 includes a touch panel and various hardware keys. The controller 6 controls each of the components installed in the image forming apparatus 1. The details of the controller 6 will be described later.

Figure 2:
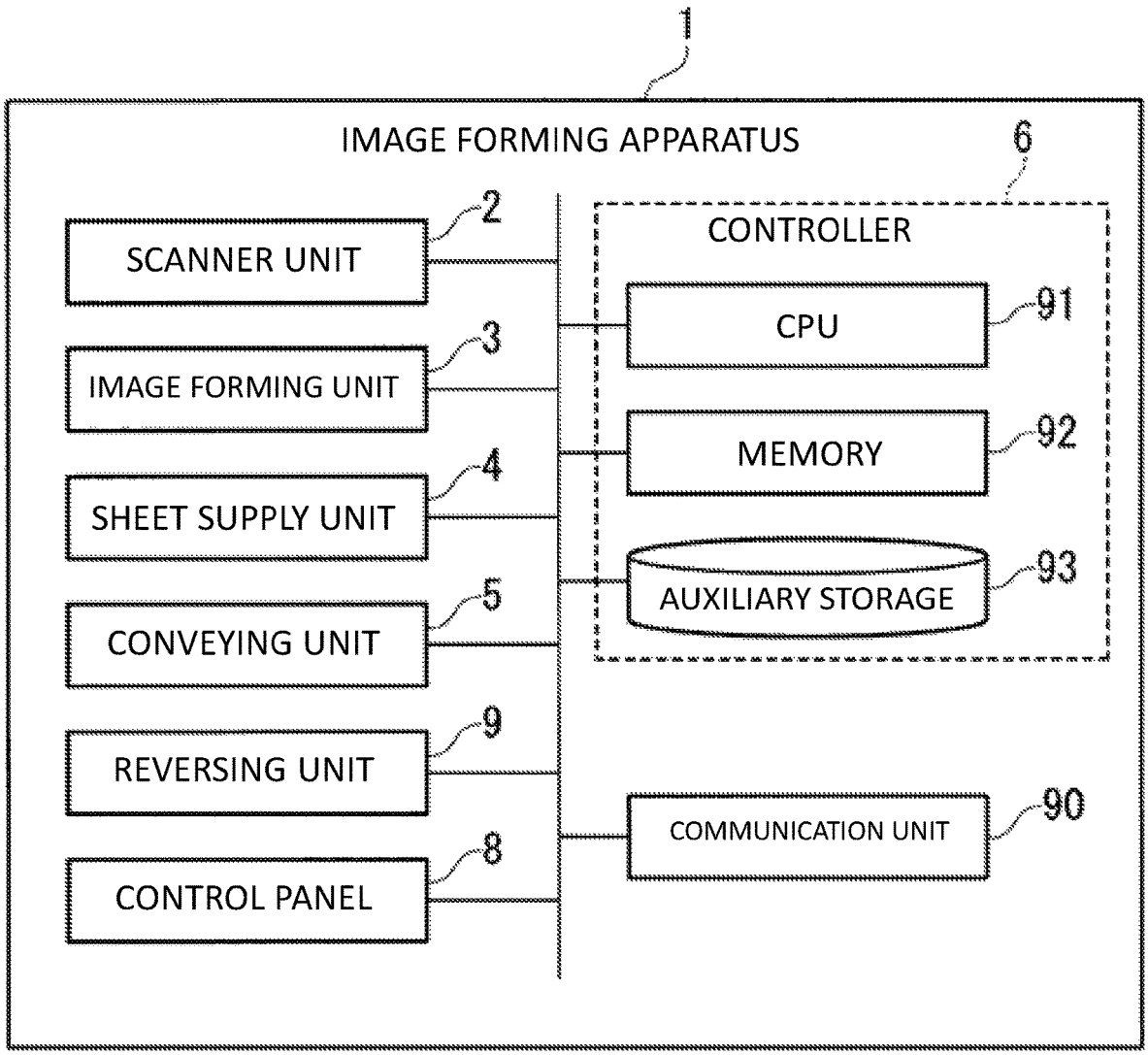
FIG. 2 is a hardware configuration diagram of the image forming apparatus.

FIG. 2 is a hardware configuration diagram of an image forming apparatus according to an embodiment of the present invention. The image forming apparatus 1 includes a CPU (Central Processing Unit) 91, a memory 92, an auxiliary storage device 93, and the like connected by a bus, and executes a program. As described above, the image forming apparatus 1 includes the scanner unit 2, the image forming unit 3, the sheet supply unit 4, the conveying unit 5, the reversing unit 9, the control panel 8, and a communication unit 90.

The CPU 91 is a component of the controller 6 and executes programs stored in the memory 92 and the auxiliary storage device 93 to achieve each function of the image forming apparatus 1. The auxiliary storage device 93 comprises a magnetic hard disk device or a semiconductor storage device. The auxiliary storage device 93 stores information. The communication unit 90 includes a communication interface for connecting the image forming apparatus 1 with an external apparatus.

Figure 3:
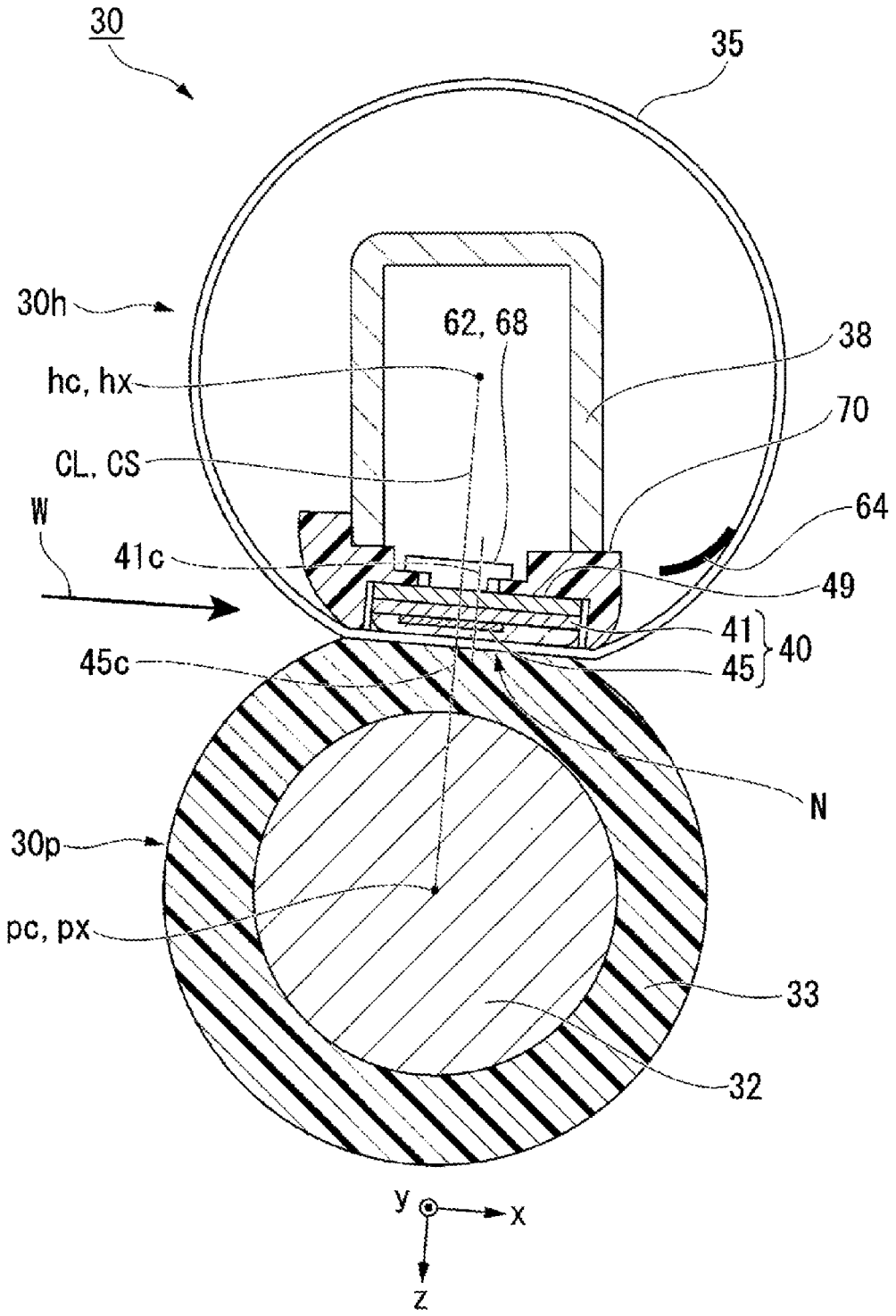
FIG. 3 is a front sectional view of a fixing unit according to one embodiment.

The fixing device 30 will be described in detail. FIG. 3 is a front sectional view of the fixing device 30. The fixing device 30 includes a pressing roller 30*p* and a film unit 30*h*.

The pressing roller 30*p* forms a nip N with the film unit 30*h*. The pressing roller 30*p* pressurizes the toner image on the sheet S that has entered into the nip N. The pressing roller 30*p* rotates and conveys the sheet S. The pressing roller 30*p* includes a core metal 32, an elastic layer 33, and a release layer (not shown).

The core metal 32 is made of a metal material such as stainless steel, and is formed in a cylindrical shape. Both end portions in the axial direction of the core metal 32 are supported. The core metal 32 is driven to rotate by a motor (not shown). The core metal 32 comes into contact with a cam member (not shown). In accordance with a rotation of the cam member, the core metal 32 moves towards and away from the film unit 30*h*.

The elastic layer 33 is formed of an elastic material such as silicone rubber. The elastic layer 33 is formed to have a constant thickness on the outer peripheral surface of the core metal 32. The release layer (not shown) is made of a resin material such as PFA (tetrafluoroethylene perfluoroalkyl vinyl ether copolymer). The release layer is formed on the outer peripheral surface of the elastic layer 33. It is preferable that the hardness of the outer circumferential surface of the pressing roller 30*p* is temperature 40° C.-70° C. under a load of 9.8N by ASKER-C hardness meter. As a result, the area of the nip N and the durability of the pressing roller 30*p* are secured.

The pressing roller 30*p* is able to move toward and away from the film unit 30*h* by the rotation of the cam member. When the pressing roller 30*p* is brought close to the film unit 30*h* and pressed by a pressing spring, a nip N is formed. On the other hand, when the sheet S is jammed in the fixing device 30, the pressing roller 30*p* is separated from the film unit 30*h*, whereby the sheet S can be removed. In addition, while a cylindrical film 35 is stationary instead of the rotation, during sleep mode, the pressing roller 30*p* is separated from the film unit 30*h*, thereby preventing a deformation of the cylindrical film 35.

The pressing roller 30*p* is rotated by a motor. When the pressing roller 30*p* rotates in a state where the nip N is formed, the cylindrical film 35 of the film unit 30*h* rotates accordingly. The pressing roller 30*p* conveys the sheet S in the conveying direction W by rotating while nipping the sheet in the nip N.

The film unit 30*h* heats the toner image of the sheet S that has entered the nip N. The film unit 30*h* includes the cylindrical film 35, a heater unit 40, a heat conductor 49, a guide member 70, a stay 38, a heater thermometer 62, a thermostat 68, and a film thermometer 64.

The cylindrical film 35 is formed in a cylindrical shape. The cylindrical film 35 has a base layer, an elastic layer, and a release layer in this order from the inner peripheral side. The base layer is formed in a cylindrical shape by a material such as nickel (Ni) or the like. The elastic layer is laminated and arranged on the outer peripheral surface of the base layer. The elastic layer is formed of an elastic material such as silicone rubber. The release layer is laminated and arranged on the outer peripheral surface of the elastic layer. The release layer is formed of a material such as a PFA resin.

Figure 4:
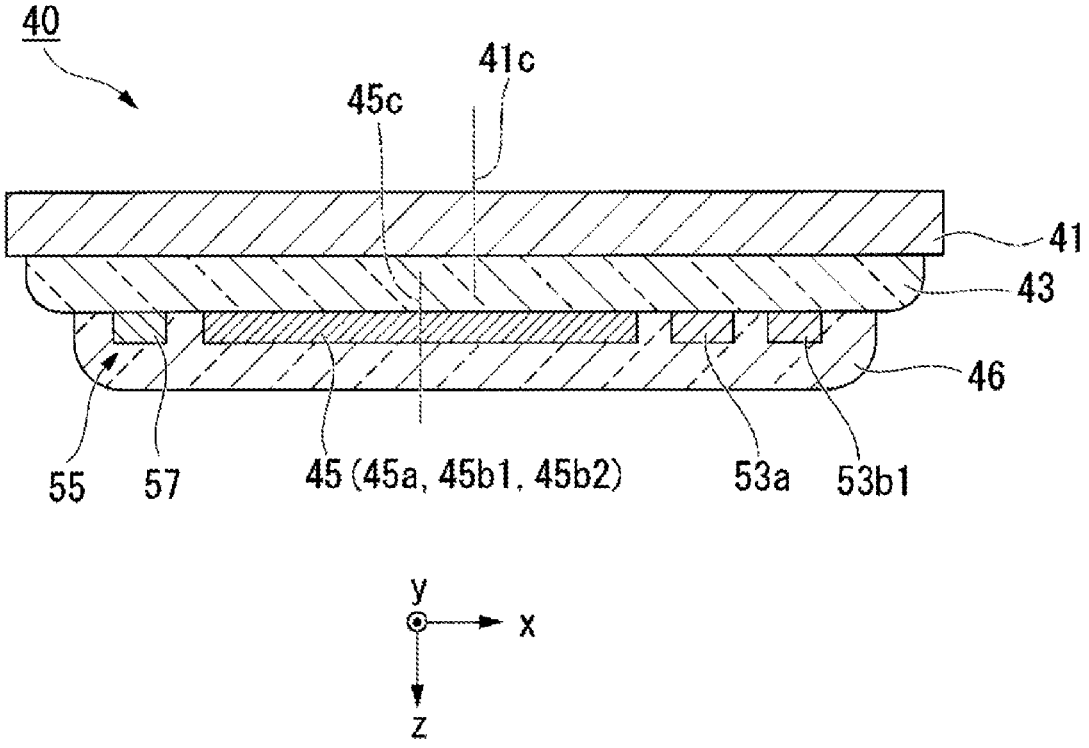
FIG. 4 is a front sectional view of a heater unit of the fixing unit.
Figure 5:
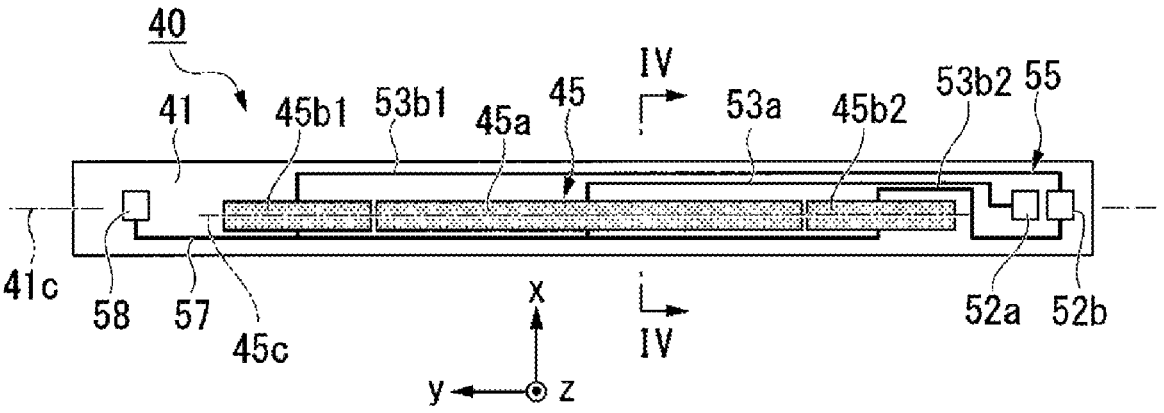
FIG. 5 is a bottom view of the heater unit.

FIG. 4 is a front sectional view of the heater unit 40 taken along the line IV-IV in FIG. 5. FIG. 5 is a bottom view of the heater unit 40 (i.e., viewed from the +z direction). The heater unit 40 includes a substrate 41, a heating element set 45, and a wiring set 55.

The substrate 41 is made of a metal material such as stainless steel, a ceramic material such as aluminum nitride, or the like. The substrate 41 is formed in an elongated rectangular plate shape. The substrate 41 is disposed inside the cylindrical film 35 in the radial direction. In the substrate 41, the longitudinal direction corresponds to the axial direction of the cylindrical film 35.

In the present application, the x direction, the y direction, and the z direction are defined as follows. The y direction is the longitudinal direction of the substrate 41. As will be described later, the +y direction is a direction from the central heating element 45*a* to a first end heating element 45*b*1. The x direction is the lateral direction of the substrate 41, and the +x direction is the transport direction (i.e., the downstream side) of the sheet S. The z direction is a normal direction of the substrate 41, and the +z direction is a direction in which the heating element set 45 is arranged with respect to the substrate 41. As shown in FIG. 4, an insulating layer 43 is formed on the surface of the substrate 41 in the +z direction by a glass material or the like.

The heating element set 45 is disposed on the substrate 41. As shown in FIG. 4, the heating element set 45 is formed on the surface of the insulating layer 43 in the +z direction. The heating element set 45 is formed of a silver-palladium alloy or the like. The heating element set 45 has a rectangular shape in which the y direction is the longitudinal direction and the x direction is the short direction.

As shown in FIG. 5, the heating element set 45 includes a first end heating element 45*b*1, a central heating element 45*a*, and a second end heating element 45*b*2 which are arranged side by side in the y direction. The central heating element 45*a* is disposed at a central portion in the y direction of the heating element set 45. The central heating element 45*a* may be configured by combining a plurality of small heating elements arranged side by side in the y direction. The first end heating element 45*b*1 is disposed at the +y direction end of the central heating element 45*a* and at the end portion of the heating element set 45 in the +y direction. The second end heating element 45*b*2 is disposed in the −y direction of the central heating element 45*a* and at the end of the heating element set 45 in the −y direction. The boundary line between the central heating element 45*a* and the first end heating element 45*b*1 may be arranged parallel to the x direction, or may be arranged to intersect with the x direction. The same applies to the boundary line between the central heating element 45*a* and the second end heating element 45*b*2.

The heating element set 45 generates heat by energization. The electric resistance value of the central heating element 45*a* is smaller than the electric resistance value of the first end heating element 45*b*1 and the second end heating element 45*b*2.

The sheet S having a small width in the y direction passes through the central portion in the y direction of the fixing device 30. In this case, the controller 6 generates heat only in the central heating element 45*a*. On the other hand, in the case of a sheet S having a large width in the y direction, the controller 6 generates heat of the entire heating element set 45. Therefore, the heat generation is controlled independently of the central heating element 45*a*, the first end heating element 45*b*1, and the second end heating element 45*b*2. The heat generation of the first end heating element 45*b*1 and the second end heating element 45*b*2 is controlled in the same manner.

The wiring set 55 is made of a metal material such as silver. The wiring set 55 includes a central contact point 52*a*, a central wiring 53*a*, an end contact point 52*b*, a first end wiring 53*b*1, a second end wiring 53*b*2, a common contact 58, and a common wiring 57.

The center contact 52*a* is arranged on the −y direction side of the heating element set 45. The central wiring 53*a* is arranged on the +x direction side of the heating element set 45. The central wiring 53*a* connects the side in the +x direction of the central heat element 45*a* and the center part contact 52*a*.

The end contact 52*b* is arranged on the −y direction side of the central contact 52*a*. The first end wiring 53*b*1 extends along the side in the +x direction of the heating element set 45 and on the +x direction side of the center wiring 53*a*. The first end wiring 53*b*1 connects the end side in the +x direction of the first end heating element 45*b*1 and the end portion in the +x direction of the end contact point 52*b*. The second end wiring 53*b*2 extends along the side in the +x direction of the heating element set 45 and on the −x direction side of the center wiring 53*a*. The second end wiring 53*b*2 connects the side in the +x direction of the second end heating element 45*b*2 and the end portion in the −x direction of the end contact point 52*b*.

The common contact 58 is arranged at the end in the +y direction of the heating element set 45. The common wiring 57 extends along the side in the −x direction of the heating element set 45. The common wiring 57 connects the end side in the −x direction of the central heating element 45*a*, the first end heating element 45*b*1, and the second end heating element 45*b*2 to the common contact 58.

In this manner, the second end wiring 53*b*2, the central wiring 53*a*, and the first end wiring 53*b*1 extend along the side in the +x direction of the heating element set 45. In contrast, only the common wiring 57 extends along the side in the −x direction of the heating element set 45. Therefore, the center 45*c* in the x direction of the heating element set 45 is arranged on the −x direction side with respect to the center 41*c* in the x direction of the substrate 41.

As shown in FIG. 3, a straight line CL connecting the center pc of the pressing roller 30*p* and the center hc of the film unit 30*h* or cylindrical film 35 is defined. A reference surface CS including the center axis px of the pressing roller 30*p* and the center axis hx of the film unit 30*h* or cylindrical film 35 is defined.

Figure 6:
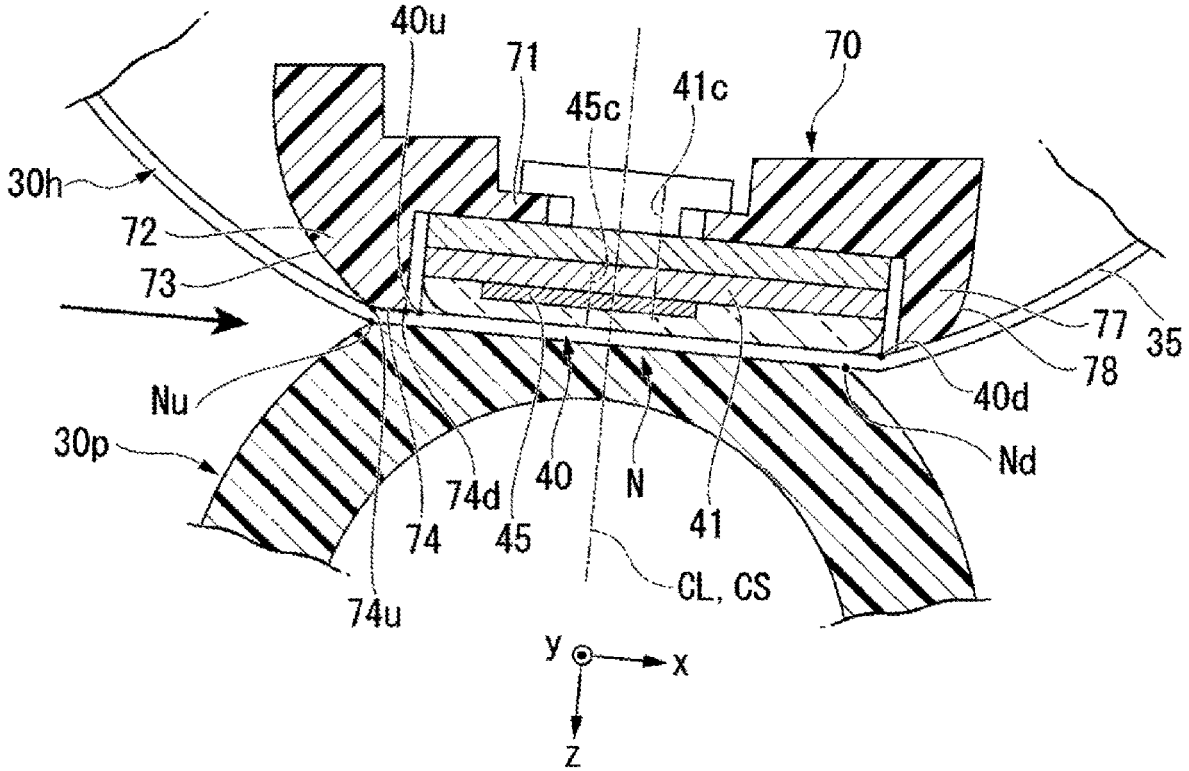
FIG. 6 is an enlarged view of the vicinity of a nip shown in FIG. 3.

FIG. 6 is an enlarged view of the periphery of the nip N shown in FIG. 3. As shown in FIG. 6, the center 41*c* in the x direction of the substrate 41 is arranged on the +x direction side with respect to the straight line CL or the reference surface CS. In this way, the heater unit 40 extends in the +x direction. The end portion 40*d* in the +x direction of the heater unit 40 is arranged on the +x direction side with respect to the end portion Nd in the +x direction of the nip N. As a result, the heater unit 40 extends in the +x direction of the nip N. Accordingly, the sheet S that has passed through the nip N is easily peeled off from the film unit 30*h*.

The center 45*c* in the x direction of the heating element set 45 is arranged on the −x direction side with respect to the straight line CL or the reference surface CS. As a result, the distance in the x direction from the heating element set 45 to the end Nd in the +x direction of the nip N becomes long, and the temperature in the +x direction of the nip N decreases. Therefore, the temperature of the sheet S that has passed through the nip N is lowered, so that the sheet S on which the toner has been adhered is hardly stuck to the cylindrical film 35. Accordingly, the sheet S that has passed through the nip N is easily peeled off from the film unit 30*h*.

The heating element set 45 is disposed within the range of the nip N in the x direction and the y direction. As a result, the sheet S passing through the nip N is heated sufficiently.

As shown in FIG. 4, the heating element set 45 and the wiring set 55 are formed on the surface of the insulating layer 43 in the +z direction. A protective layer 46 is formed of a glass material or the like so as to cover the heating element set 45 and the wiring set 55. The protective layer 46 improves the sliding property between the heater unit 40 and the cylindrical film 35.

As shown in FIG. 3, the heater unit 40 is disposed inside the cylindrical film 35. A lubricant (not shown) is applied to the inner peripheral surface of the cylindrical film 35. The heater unit 40 is brought into contact with the inner peripheral surface of the cylindrical film 35 through the lubricant. When the heater unit 40 generates heat, the viscosity of the lubricant is lowered. Thus, the sliding property between the heater unit 40 and the cylindrical film 35 is secured.

The heat conductor 49 is made of a metal material having a high thermal conductivity such as copper. The outer shape of the heat conductor 49 is equivalent to the outer shape of the substrate 41 of the heater unit 40. The heat conductor 49 is disposed in contact with the surface of the heater unit 40 in the −z direction.

When the sheet S passing through the fixing device 30 is heated, a temperature distribution is generated in the heater unit 40 in accordance with the size of the sheet S. When the heater unit 40 is locally heated to a high temperature, the heat resistance temperature of the guide member 70 formed of a resin material may exceed the heat resistant temperature. The heat conductor 49 averages the temperature distribution of the heater unit 40. As a result, heat resistance of the guide member 70 is secured.

The guide member 70 is made of a resin material such as a liquid crystal polymer. The guide member 70 extends along the y direction. The guide member 70 is disposed so as to cover the side in the −z direction of the heater unit 40 and both sides in the x direction thereof. The guide member 70 will be described in detail later.

The stay 38 is formed of a steel sheet material or the like. A cross section perpendicular to the y direction of the stay 38 is formed in a U shape. The stay 38 is mounted on the surface in the −z direction of the guide member 70 so as to block the opening of the U with the guide member 70. The stay 38 extends in the y direction. Both end portions in the y direction of the stay 38 are fixed to the housing of the image forming apparatus 1. As a result, the film unit 30*h* is supported by the image forming apparatus 1. The stay improves the bending rigidity of the film unit 30*h*. A flange (not shown) for restricting the movement of the cylindrical film 35 in the y direction is mounted in the vicinity of both end portions in the y direction of the stay 38.

The heater thermometer 62 is disposed in the −z direction of the heater unit 40 with the heat conductor 49 interposed therebetween. For example, the heater thermometer 62 may be a thermistor. The heater thermometer 62 is mounted on and supported by a surface in the −z direction of the guide member 70. The temperature sensing element of the heater thermometer 62 contacts the heat conductor 49 through a hole passing through the guide member 70 in the z direction. The heater thermometer 62 measures the temperature of the heater unit 40 via the heat conductor 49.

The thermostat 68 is disposed in the same manner as the heater thermometer 62. When the temperature of the heater unit 40 detected through the heat conductor 49 exceeds a predetermined temperature, the thermostat 68 cuts off the power supply to the heating element set 45.

The film thermometer 64 is disposed inside the cylindrical film 35 and on the +x direction side of the heater unit 40. The film thermometer 64 measures the temperature of the cylindrical film 35 by making contact with the inner peripheral surface of the cylindrical film 35.

The guide member 70 will be described in detail.

As shown in FIG. 6, the guide member 70 includes a support portion 71, a first guide portion 72, and a second guide portion 77.

The support portion 71 is disposed on the −z direction side of the heater unit 40. The support portion 71 supports the heater unit 40 via the heat conductor 49. The first guide portion 72 and the second guide portion 77 are extended in the −z direction of the heater unit 40 to form the support portion 71. Since the guide member 70 is integrally formed, an increase in the number of components is suppressed, thereby reducing the cost of the fixing device 30.

The first guide portion 72 is disposed on the −x direction side of the heater unit 40. A first plane 74 is formed at an end portion in the +z direction and the +x direction of the first guide portion 72. The surface in the +z direction of the first plane 74 is parallel to the surface in the +z direction of the heater unit 40. A first curved surface 73 is formed continuously in the −x direction of the first plane 74 of the first guide portion 72. The first curved surface 73 is a curved surface that is curved in the −z direction toward the −x direction. The first flat surface and the first curved surface 73 guide the inner circumferential surface of the cylindrical film 35 in the −x direction of the nip N.

The end portion 40*u* in the −x direction of the heater unit 40 is arranged on the +x direction side with respect to the end portion Nu in the −x direction of the nip N. The end portion 40*u* in the −x direction of the heater unit 40 is included inside the x direction of the nip N. Inside the nip N, the cylindrical film 35 is stably held. Therefore, it is possible to prevent the cylindrical film 35 from being damaged by rubbing against the end portion 40*u* of the heater unit 40. Therefore, the durability of the fixing device 30 is improved.

An end portion 74*d* in the +x direction of the first plane 74 of the first guide portion 72 is disposed on the +x direction side with respect to the end portion Nu in the −x direction of the nip N. In this way, a part of the cylindrical film 35 forming the nip N in the −x direction is supported by the first guide portion 72. The end portion 74*u* in the −x direction of the first plane 74 is disposed at the same position in the same x direction as the end portion Nu in the −x direction of the nip N, or is disposed on the −x direction side with respect to the end portion Nu. Accordingly, the end portion in the −x direction of the cylindrical film 35 forming the nip N is supported by the first flat surface 74 of the first guide portion 72. Thus, the nip N is formed by using the first guide portion 72.

By forming the nip N by using the first guide portion 72, the length in the x direction of the nip N becomes long. The cylindrical film 35 is stably held in the nip N, and the deflection of the cylindrical film 35 is suppressed. The sheet S going to enter the nip N is prevented from colliding with the deflection of the cylindrical film 35. Therefore, the entry of the sheet S into the nip N is stabilized.

Figure 7:
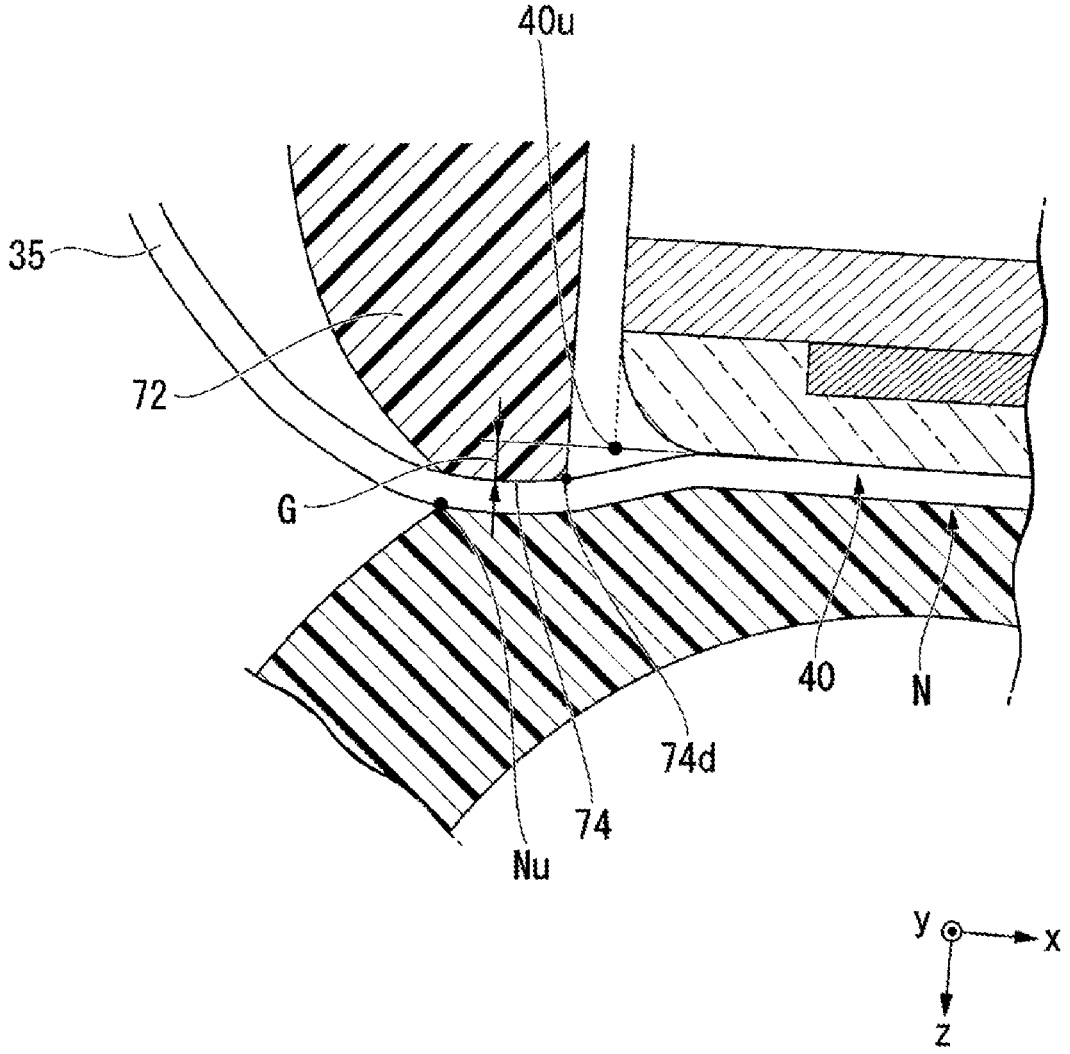
FIG. 7 is an enlarged view on the upstream side of the nip.

FIG. 7 is an enlarged view of the upstream side of the nip N shown in FIG. 3. The end portions 74*d* in the +x direction and +z direction of the first guide portion 72 protrude in the +z direction from the heater unit 40. The projection amount is the gap G. In other words, the first plane 74 of the first guide portion 72 is disposed on the +z direction side with respect to the surface in the +z direction of the heater unit 40.

Accordingly, the cylindrical film 35 is prevented from being damaged by rubbing against the end portions 40*u* in the −x direction and the +z direction of the heater unit 40. Therefore, the durability of the fixing device 30 is improved. Rounded chamfering is formed in the end portion 40*u* in the −x direction and the +z direction of the heater unit 40. As a result, damage to the cylindrical film 35 is suppressed, and durability of the fixing device 30 is improved.

As shown in FIG. 6, the second guide portion 77 is disposed on the +x direction side of the heater unit 40. A second curved surface 78 is formed at an end portion in the +z direction of the second guide portion 77. The second curved surface 78 is a curved surface that curves in the −z direction toward the +x direction. The second curved surface guides the inner circumferential surface of the cylindrical film 35 in the +x direction of the nip N.

The end portions in the −x direction and the +z direction of the second guide portion 77 protrude in the +z direction from the heater unit 40. Accordingly, the cylindrical film 35 is prevented from being damaged by rubbing against the end portions 40*u* in the +x direction and the +z direction of the heater unit 40. Therefore, the durability of the fixing device 30 is improved.

As described in detail above, the fixing device 30 of the embodiment includes the cylindrical film 35, the pressing roller 30*p*, the heating element set 45, the heater unit 40, and the guide member 70. The pressing roller 30*p* can be brought into contact with the cylindrical film 35 to form the nip N, and can be rotated to convey the sheet S sandwiched by the nip N. The heating element set 45 is arranged inside the cylindrical film 35 such that the axial direction of the cylindrical film 35 is parallel to the longitudinal direction of the heating element set 45. In the heating element set 45, the center 45*c* in the lateral direction is arranged on the −x direction side with respect to the reference surface CS including the center axis hx of the cylindrical film 35 and the center axis px of the pressing roller 30*p*. The heater unit 40 has the heating element set 45, and is brought into contact with the inner surface of the cylindrical film 35. The guide member 70 is disposed inside the cylindrical film 35, and includes parts disposed on the −x and +x direction sides with respect to the heater unit 40. In the guide member 70, the end portion 74*d* in the +x direction is arranged on the +x direction side with respect to the end portion Nu in the −x direction in the nip N. The guide member 70 is arranged such that the end portion 74*d* thereof is disposed on the side of the pressing roller 30*p* from the heater unit 40.

In the heating element set 45, the center 45*c* in the lateral direction is arranged on the −x direction side with respect to the reference surface CS. Thereby, the temperature in the +x direction of the nip N is lowered. Accordingly, the sheet S that has passed through the nip N is easily peeled off from the cylindrical film 35.

In the guide member 70, the end portion 74*d* in the +x direction is arranged on the +x direction side with respect to the end portion Nu in the −x direction in the nip N. Since the nip N is formed by using the guide member 70, the nip N becomes longer. The cylindrical film 35 is stably held, and the deflection of the cylindrical film 35 is suppressed. Therefore, the entry of the sheet S into the nip N is stabilized.

In the guide member 70, the end portion 74*d* in the +x direction is arranged closer to the pressing roller 30*p* than the heater unit 40. Accordingly, the cylindrical film 35 is prevented from being damaged by rubbing against the end portion 40*u* in the −x direction of the heater unit 40. Therefore, the durability of the fixing device 30 is improved.

In the heater unit 40, the axial direction of the cylindrical film 35 corresponds to the longitudinal direction, and the center 41*c* in the lateral direction is arranged on the +x direction side from the reference surface CS. Thus, the heater unit 40 extends toward the +x direction, so that the sheet S which has passed through the nip N is easily peeled off from the cylindrical film 35.

The end portion in the +x direction in the heater unit 40 is arranged on the +x direction side with respect to the end portion Nd in the +x direction in the nip N. Accordingly, the heater unit 40 extends toward the +x direction of the nip N, so that the sheet S which has passed through the nip N is easily peeled off from the cylindrical film 35.

The heating element set 45 is disposed within a range of the nip N in the longitudinal direction and in the lateral direction. As a result, the sheet S passing through the nip N is heated sufficiently.

The guide member 70 is extended to the opposite side of the pressing roller 30*p* with the heater unit 40 interposed therebetween to support the heater unit 40. Thereby, the increase in the number of parts is suppressed, so that the fixing device 30 is reduced in cost.

In the aforementioned embodiments, the image forming apparatus 1 and the fixing unit 30 are described as examples of an image processing apparatus and a heating apparatus. Another example of the image processing apparatus is a decoloring apparatus having a decoloring unit. The decoloring apparatus performs a process of decoloring (i.e., erasing) an image formed on a sheet by a decolorable toner. The decoloring unit heats the decolorable toner image formed on the sheet passing through the nip to decolorize the toner image.

According to at least one embodiment described above, the end portion 70*d* in the +x direction of the guide member 74 is disposed closer to the pressing roller 30*p* than the heater unit 40. As a result, durability of the fixing device 30 is improved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The embodiments and variations thereof are included within the scope and spirit of the invention, and are included within the scope of the appended claims and their equivalents.

What is claimed is:

1. A heating apparatus comprising:

a cylindrical film;

a pressing element that rotates with the cylindrical film and forms a nip with the cylindrical film, wherein a medium is conveyed through the nip from an upstream side to a downstream side;

a guide member arranged inside the cylindrical film and including a first end portion that contacts the cylindrical film at a location that is downstream of an upstream end of the nip; and a substrate arranged inside the cylindrical film and on which a heating element is disposed, wherein an upstream end of the substrate is located downstream of the first end portion of the guide member, and a downstream end of the substrate is located downstream of a downstream end of the nip.

2. The heating apparatus according to claim 1, wherein the first end portion of the guide member is located closer to the pressing element than the heating element in a direction perpendicular to a direction along which the medium is conveyed through the nip.

3. The heating apparatus according to claim 1, wherein the guide member includes first and second guide portions, the first guide portion is located upstream of the upstream end of the substrate, and the second guide portion is located downstream of a downstream end of the heating element.

4. The heating apparatus according to claim 3, wherein the first end portion of the guide member is included in the first guide portion.

5. The heating apparatus according to claim 3, wherein the second guide portion includes a curved surface that contacts the cylindrical film.

6. The heating apparatus according to claim 1, wherein the substrate is supported by the guide member.

7. The heating apparatus according to claim 1, wherein the guide member is arranged opposite to the pressing element with respect to the cylindrical film.

8. The heating apparatus according to claim 1, further comprising:

a plurality of heating elements on the substrate arranged along a longitudinal direction thereof.

9. The heating apparatus according to claim 1, wherein a center of the substrate in a sheet conveyance direction is located downstream of a center of the nip.

10. An image processing apparatus comprising:

an image forming unit configured to form an image on a sheet; and a fixing unit configured to fix the image on the sheet and including:

a cylindrical film, a pressing element that rotates with the cylindrical film and forms a nip with the cylindrical film, wherein a medium is conveyed through the nip from an upstream side to a downstream side, a guide member arranged inside the cylindrical film and including a first end portion that contacts the cylindrical film at a location that is downstream of an upstream end of the nip, and a substrate arranged inside the cylindrical film and on which a heating element is disposed, wherein an upstream end of the substrate is located downstream of the first end portion of the guide member, and a downstream end of the substrate is located downstream of a downstream end of the nip.

11. The image processing apparatus according to claim 10, wherein the first end portion of the guide member is located closer to the pressing element than the heating element in a direction perpendicular to a direction along which the medium is conveyed through the nip.

12. The image processing apparatus according to claim 10, wherein the guide member includes first and second guide portions, the first guide portion is located upstream of the upstream end of the substrate, and the second guide portion is located downstream of a downstream end of the heating element.

13. The image processing apparatus according to claim 12, wherein the first end portion of the guide member is included in the first guide portion.

14. The image processing apparatus according to claim 12, wherein the second guide portion includes a curved surface that contacts the cylindrical film.

15. The image processing apparatus according to claim 10, wherein the substrate is supported by the guide member.

16. The image processing apparatus according to claim 10, wherein the guide member is arranged opposite to the pressing element with respect to the cylindrical film.

17. The image processing apparatus according to claim 10, wherein the fixing unit further includes a plurality of heating elements on the substrate arranged along a longitudinal direction thereof.

18. The image processing apparatus according to claim 10, wherein a center of the substrate in a sheet conveyance direction is located downstream of a center of the nip.

* * * * *